US010991311B2

(12) United States Patent
Yu

(10) Patent No.: US 10,991,311 B2
(45) Date of Patent: Apr. 27, 2021

(54) PIXEL CIRCUIT AND METHOD FOR DRIVING THE SAME, DISPLAY PANEL AND DISPLAY APPARATUS

(71) Applicants: Chengdu BOE Optoelectronics Technology Co., Ltd., Chengdu (CN); BOE Technology Group Co., Ltd., Beijing (CN)

(72) Inventor: Ziyang Yu, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/807,378

(22) Filed: Mar. 3, 2020

(65) Prior Publication Data

US 2021/0056903 A1 Feb. 25, 2021

(30) Foreign Application Priority Data

Jul. 17, 2019 (CN) ..... 201910646657.8

(51) Int. Cl.
*G09G 3/3258* (2016.01)

(52) U.S. Cl.
CPC ..... *G09G 3/3258* (2013.01); *G09G 2300/043* (2013.01); *G09G 2300/0426* (2013.01); *G09G 2300/0842* (2013.01)

(58) Field of Classification Search
CPC .. G09G 3/3258; G09G 3/3233; G09G 3/3241; G09G 3/325; G09G 2300/043;
(Continued)

(56) References Cited

U.S. PATENT DOCUMENTS 10,204,555 B2 2/2019 Tan et al.
10,210,803 B2 2/2019 Wu et al.
(Continued)

FOREIGN PATENT DOCUMENTS

CN 101331533 A 12/2008
CN 103295519 A 9/2013
(Continued)

OTHER PUBLICATIONS

First Office Action, including Search Report, for Chinese Patent Application No. 201910646657.8, dated Jun. 5, 2020, 20 pages.
(Continued)

*Primary Examiner* — Dong Hui Liang
(74) *Attorney, Agent, or Firm* — Westman, Champlin & Koehler, P.A.

(57) ABSTRACT

The embodiments of the present disclosure provide a pixel circuit and a method for driving the same, a display panel and a display apparatus. The pixel circuit includes: a storage capacitor having a first terminal coupled to receive a first control signal; a first transistor having a first electrode electrically coupled to a first voltage signal terminal, and a gate electrically coupled to a second terminal of the storage capacitor; and a second transistor having a first electrode electrically coupled to the second terminal of the storage capacitor, a second electrode electrically coupled to a second electrode of the first transistor, and a gate coupled to receive a second control signal. A threshold voltage of the first transistor is compensated through the first control signal, the second control signal and a voltage signal applied at the first voltage signal terminal.

9 Claims, 9 Drawing Sheets

(58) Field of Classification Search
CPC ..... G09G 2320/045; G09G 2320/0219; G09G 2300/0842; G09G 2300/0847; G09G 2300/0852
See application file for complete search history.

(56) References Cited

U.S. PATENT DOCUMENTS

| | | | | |
|---|---|---|---|---|
| 10,529,289 | B2 | 1/2020 | Chung et al. | |
| 2004/0257359 | A1* | 12/2004 | Muroi | H01L 27/12 345/212 |
| 2008/0303749 | A1 | 12/2008 | Cassidy et al. | |
| 2011/0050736 | A1* | 3/2011 | Fan | G09G 3/3233 345/690 |
| 2011/0234957 | A1* | 9/2011 | Watanabe | G02F 1/1345 349/139 |
| 2011/0279437 | A1* | 11/2011 | Komiya | G09G 3/3233 345/212 |
| 2012/0293479 | A1* | 11/2012 | Han | G09G 3/3266 345/212 |
| 2015/0002557 | A1* | 1/2015 | Ishii | G09G 3/3233 345/690 |
| 2015/0062195 | A1* | 3/2015 | Kumeta | G09G 3/3233 345/690 |
| 2015/0221252 | A1* | 8/2015 | Qing | G09G 3/3291 345/76 |
| 2016/0104418 | A1* | 4/2016 | Keum | G09G 3/3208 345/76 |
| 2016/0140900 | A1* | 5/2016 | Yang | G09G 3/3258 345/206 |
| 2016/0274692 | A1* | 9/2016 | Yang | G09G 3/3266 |
| 2016/0284274 | A1 | 9/2016 | Tan et al. | |
| 2016/0351124 | A1* | 12/2016 | Kim | G09G 3/3241 |
| 2017/0110049 | A1 | 4/2017 | Choi | |
| 2017/0162115 | A1* | 6/2017 | Chen | H01L 27/1222 |
| 2017/0243537 | A1* | 8/2017 | Wu | G09G 3/3233 |
| 2017/0330511 | A1* | 11/2017 | Feng | G09G 3/3233 |
| 2018/0047337 | A1* | 2/2018 | Zhu | G09G 3/3233 |
| 2019/0130846 | A1 | 5/2019 | Chung et al. | |
| 2019/0266950 | A1* | 8/2019 | Xu | G09G 3/3233 |

FOREIGN PATENT DOCUMENTS

| | | | |
|---|---|---|---|
| CN | 104123912 | A | 10/2014 |
| CN | 106531067 | A | 3/2017 |
| CN | 108520719 | A | 9/2018 |
| CN | 109727579 | A | 5/2019 |

OTHER PUBLICATIONS

Third Office Action, including search report, for Chinese Patent Application No. 201910646657.8, dated Feb. 1, 2021, 26 pages.

* cited by examiner

PIXEL CIRCUIT AND METHOD FOR DRIVING THE SAME, DISPLAY PANEL AND DISPLAY APPARATUS

CROSS-REFERENCE TO RELATED APPLICATION(S)

This application claims priority to the Chinese Patent Application No. 201910646657.8, filed on Jul. 17, 2019, which is incorporated herein by reference in its entirety.

TECHNICAL FIELD

The present disclosure relates to the field of display technology, and more particularly, to a pixel circuit, a method for driving a pixel circuit, a display panel and a display apparatus.

BACKGROUND

For example, light emission of a light emitting element of an Organic Light Emitting Diode (OLED) may be realized by using a current-driven method, and therefore there are high requirements for stability of current of a Driving Thin Film Transistor (DTFT). However, stability of a DTFT manufactured by using a Low Temperature Poly-silicon (LTPS) process generally may not be maintained, and a threshold voltage Vth and mobility of the DTFT may shift under action of Excimer Laser Annealing (ELA) crystallization, long-term pressure, temperature changes, etc. Therefore, complex pixel circuits such as 7T1C (having seven transistors and one capacitor) are required to perform compensation for the DTFT to ensure that the DTFT outputs stable current under different operating conditions, thereby ensuring the display effect and lifetime of an OLED display.

However, due to the limited process capability of manufacturing a display panel, as the Pixels Per Inch (PPI) of the display panel increases, the above pixel circuits may not be used to perform driving to realize display with a high PPI.

SUMMARY

According to a first aspect of the embodiments of the present disclosure, there is proposed a pixel circuit, comprising: a storage capacitor having a first terminal electrically coupled to a first control signal terminal for providing a first control signal; a first transistor having a first electrode electrically coupled to a first voltage signal terminal, and a gate electrically coupled to a second terminal of the storage capacitor; a second transistor having a first electrode electrically coupled to the gate of the first transistor, a second electrode electrically coupled to a second electrode of the first transistor, and a gate electrically coupled to a second control signal terminal for providing a second control signal; and a light emitting element having a first electrode electrically coupled to the second electrode of the second transistor, and a second electrode electrically coupled to a second voltage signal terminal for providing a second voltage signal.

In an example, the second transistor comprises a double-gate thin film transistor, wherein two gates of the double-gate thin film transistor are both electrically coupled to the second control signal terminal.

In an example, both of the first transistor and the second transistor are polycrystalline thin film transistors or zinc oxide thin film transistors.

In an example, the first transistor is a P-type or N-type thin film transistor, and the second transistor is a P-type or N-type thin film transistor.

In an example, the first electrode of the first transistor is a source, and the second electrode of the first transistor is a drain.

In an example, the first electrode of the first transistor is a drain, and the second electrode of the first transistor is a source.

According to a second aspect of the embodiments of the present disclosure, there is proposed a method for driving a pixel circuit according to the embodiments described above, the method comprising: turning on, during a first period, the first transistor by using a first control signal; applying, during a second period, a data voltage Vdata to the first voltage signal terminal, so that a voltage at the gate of the first transistor is Vdata+Vth, wherein Vth is a threshold voltage of the first transistor; and applying, during a third period, a first voltage ELVDD to the first voltage signal terminal, so that a voltage between the first electrode and the gate of the first transistor is Vdata+Vth−ELVDD, wherein ELVDD>Vdata.

In an example, the method for driving a pixel circuit further comprises: when both of the first transistor and the second transistor are P-type thin film transistors, providing, during a first sub-period of the first period, the first control signal at a high level, applying a low-level voltage to the first voltage signal terminal, and providing the second control signal at a low level, to pull down a voltage at the gate of the first transistor; and providing, during a second sub-period of the first period, the first control signal at a high level, and providing the second control signal at a high level.

In an example, the method for driving a pixel circuit further comprises: when both of the first transistor and the second transistor are P-type thin film transistors, providing, during a first sub-period of the second period, the second control signal at a low level, providing the first control signal at a low level, and applying a data voltage Vdata to the first voltage signal terminal, so that the voltage at the gate of the first transistor is Vdata+Vth; and providing, during a second sub-period of the second period, the second control signal at a high level, and providing the first control signal at a high level.

In an example, the method for driving a pixel circuit further comprises: when both of the first transistor and the second transistor are P-type thin film transistors, during the third period, providing the first control signal at a low level, and applying a first voltage ELVDD to the first voltage signal terminal to drive the light emitting element to emit light.

According to a third aspect of the embodiments of the present disclosure, there is proposed a display panel, comprising: the pixel circuit according to the embodiments described above; a first driver configured to output the first control signal and the second control signal to the pixel circuit; and a second driver configured to apply corresponding voltage signals to the first voltage signal terminal and the second voltage signal terminal.

According to a fourth aspect of the embodiments of the present disclosure, there is proposed a display apparatus, comprising: a housing; and the display panel according to the embodiments described above, wherein the housing is disposed opposite to the display panel.

BRIEF DESCRIPTION OF THE ACCOMPANYING DRAWINGS

DETAILED DESCRIPTION

Embodiments of the present disclosure will be described in detail below. Examples of the embodiments are shown in the accompanying drawings, throughout which the same or similar reference signs represent the same or similar elements or elements having the same or similar functions. The embodiments described below with reference to the accompanying drawings are exemplary, and are intended to explain the present disclosure, but should not be construed as limiting the present disclosure.

A pixel circuit, a method for driving a pixel circuit, a display panel, and a display apparatus according to the embodiments of the present disclosure will be described below with reference to the accompanying drawings.

Figure 1:
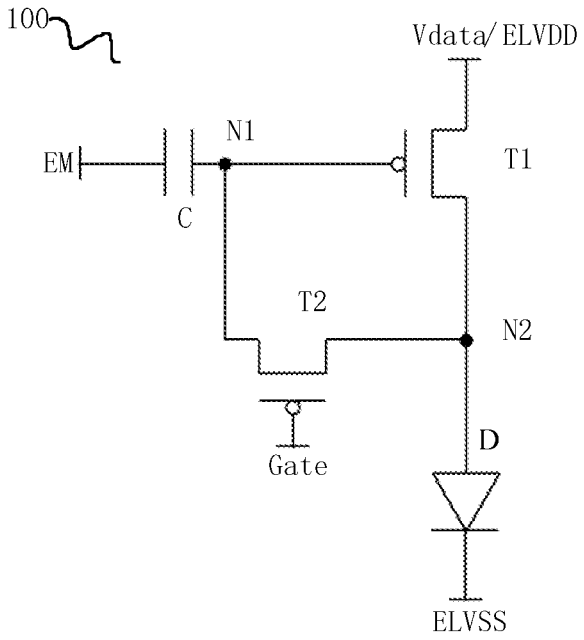
FIG. 1 is a schematic structural diagram of a pixel circuit according to an exemplary embodiment of the present disclosure.

FIG. 1 is a schematic structural diagram of a pixel circuit according to an embodiment of the present disclosure.

As shown in FIG. 1, the pixel circuit 100 may comprise a storage capacitor C, a first transistor T1, a second transistor T2, and a light emitting element D.

As shown in FIG. 1, a first terminal of the storage capacitor C is electrically coupled to a first control signal terminal EM for providing a first control signal. The first transistor T1 has a first electrode electrically coupled to a first voltage signal terminal, and a gate electrically coupled to a second terminal of the storage capacitor C at a first node N1. The second transistor T2 has a first electrode electrically coupled to the first node N1, a second electrode electrically coupled to a second electrode of the first transistor T1 at a second node N2, and a gate electrically coupled to a second control signal terminal Gate for providing a second control signal. The light emitting element D may be, for example, an organic light emitting diode. The organic light emitting diode D has a first electrode electrically coupled to the second node N2, and a second electrode electrically coupled to a second voltage signal terminal. In one example, the first electrode of the organic light emitting diode D may be an anode, the second electrode of the organic light emitting diode D may be a cathode, and a low-level ELVSS may be applied to the second voltage signal terminal. It may be understood by those skilled in the art that the above description is only an example, and the embodiments of the present disclosure are not limited thereto.

In the present embodiment, a threshold voltage Vth of the first transistor T1 may be compensated under control of the first control signal, the second control signal, and a voltage signal at the first voltage signal terminal.

It should be understood that if the first electrode of the first transistor T1 is a source, the second electrode of the first transistor T1 is a drain. If the first electrode of the first transistor T1 is a drain, the second electrode of the first transistor T1 is a source. Similarly, if the first electrode of the second transistor T2 is a source, the second electrode of the second transistor T2 is a drain; and if the first electrode of the second transistor T2 is a drain, the second electrode of the second transistor T2 is a source. Since the second transistor T2 is a switch transistor, the first electrode and the second electrode of the second transistor T2 may be interchanged.

The pixel circuit according to the embodiment of the present disclosure may use a 2T1C structure to realize compensation for the threshold voltage Vth, and therefore has a small footprint and may be widely used in display of an OLED with a high PPI.

Figure 2:
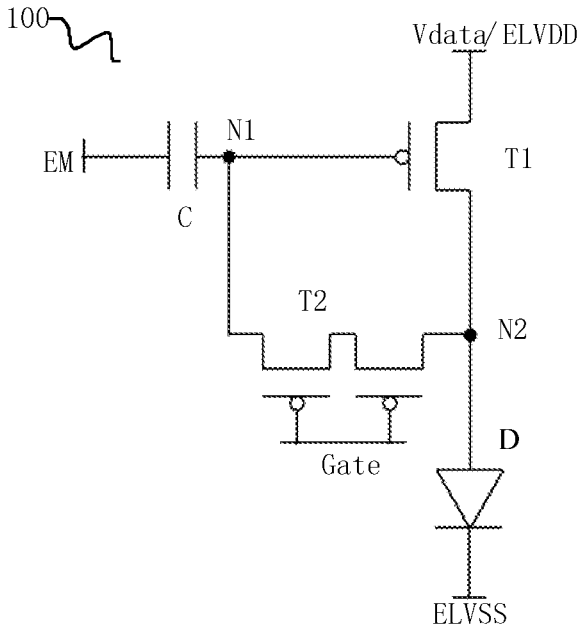
FIG. 2 is a schematic structural diagram of a pixel circuit according to another exemplary embodiment of the present disclosure.

In an embodiment of the present disclosure, as shown in FIG. 2, the second transistor T2 may be a double-gate thin film transistor. Both of two gates of the double-gate thin film transistor are electrically coupled to the second control signal terminal Gate for providing the second control signal.

In an embodiment of the present disclosure, both of the first transistor T1 and the second transistor T2 may be polycrystalline thin film transistors, for example, Low Temperature Poly-silicon (LTPS) Thin Film Transistors (TFTs), Low Temperature Polycrystalline Oxide (LTPO) TFTs etc., or may also be zinc oxide thin film transistors, for example, Indium Gallium Zinc Oxide (IGZO) TFTs.

Of course, the first transistor T1 may be a polycrystalline thin film transistor, and the second transistor T2 may be a zinc oxide thin film transistor, or the first transistor T1 may be a zinc oxide thin film transistor, and the second transistor T2 may be a polycrystalline thin film transistor.

Further, in an embodiment of the present disclosure, the first transistor T1 may be a P-type or N-type thin film transistor, and the second transistor T2 may be a P-type or N-type thin film transistor.

Figure 3:
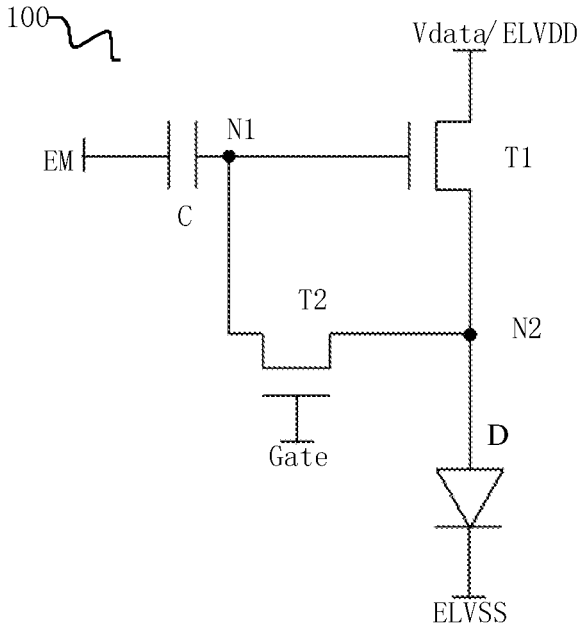
FIG. 3 is a schematic structural diagram of a pixel circuit according to yet another exemplary embodiment of the present disclosure.
Figure 4:
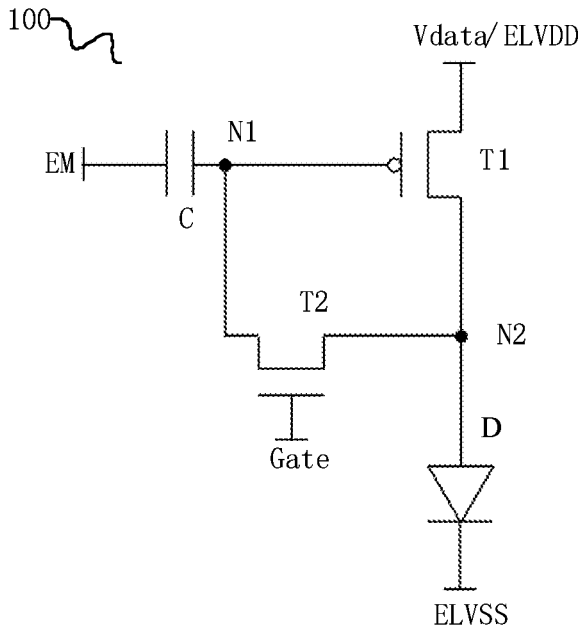
FIG. 4 is a schematic structural diagram of a pixel circuit according to still another exemplary embodiment of the present disclosure.
Figure 5:
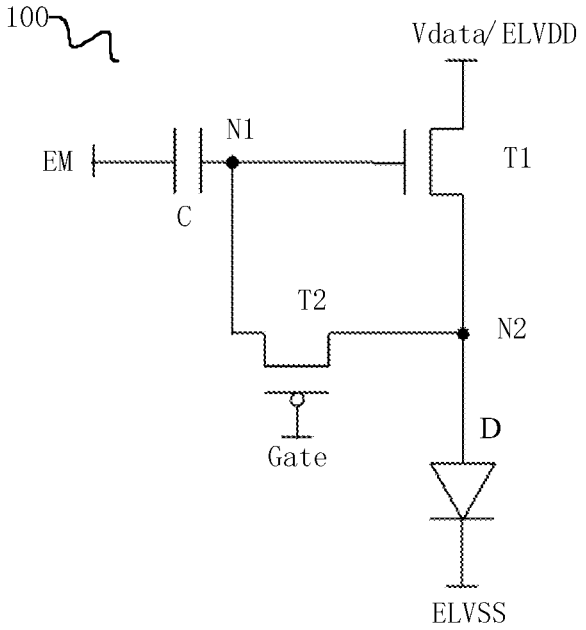
FIG. 5 is a schematic structural diagram of a pixel circuit according to another example of the present disclosure.

For example, as shown in FIG. 1, both of the first transistor T1 and the second transistor T2 are P-type thin film transistors. As shown in FIG. 3, both of the first transistor T1 and the second transistor T2 are N-type thin film transistors. As shown in FIG. 4, the first transistor T1 is a P-type thin film transistor, and the second transistor T2 is an N-type thin film transistor. As shown in FIG. 5, the first transistor T1 is an N-type thin film transistor, and the second transistor T2 is a P-type thin film transistor.

For convenience of understanding, an operating principle of the pixel circuit 100 according to the embodiment of the present disclosure will be described below in combination with a structure shown in FIG. 6A and a driving timing shown in FIG. 6B by taking the embodiment shown in FIG. 1 as an example.

Initialization is performed during a first phase $P_1$. The first phase $P_1$ may comprise a sub-period $P_{11}$ and a sub-period $P_{12}$.

During the first sub-period $P_{11}$, a second control signal input at the second control signal terminal Gate is at a low level, the second transistor T2 is turned on, a first control signal provided at the first control signal terminal EM is at a high level, and a voltage at the first node N1 is pulled up through coupling of the storage capacitor C. At this time, both of the first voltage signal terminal and the second voltage signal terminal are at low-level voltages, to pull down voltages at the first node N1 and the second node N2 to complete initialization at the first node N1.

During the sub-period $P_{12}$, the first control signal is at a high level, the second control signal is at a high level, the second transistor T2 is turned off, and the first node N1 is maintained at a relatively low voltage.

Next, during a second phase $P_2$, writing of Vdata and extraction of Vth are performed. The second phase $P_2$ may comprise a sub-period $P_{21}$ and a sub-period $P_{22}$.

During the sub-period $P_{21}$, the second control signal is at a low level, so that the second transistor T2 is turned on. The first control signal is at a low level, and the potential at the first node N1 is coupled to a low voltage through the storage capacitor C, so that the first transistor T1 is turned on. At the same time, the first voltage signal terminal provides a data voltage Vdata. Since both of the first transistor T1 and the second transistor T2 are turned on, the voltage at the first node N1 is finally Vdata+Vth, so as to realize the extraction of Vth.

During the sub-period $P_{22}$, the second control signal is at a high level, so that the second transistor T2 is turned off, and the first node N1 is floating. The first control signal is at a high level, and thus the voltage at the first node N1 is (EM_H−EM_L)+Vdata+Vth. It may be understood that in a case that the first transistor T1 is a P-type transistor, Vth has a negative value. Here, EM_H is a high-level voltage value of the first control signal, and EM_L is a low-level voltage value of the first control signal.

Then, compensation for light emission is performed during a third phase $P_3$. The first control signal is at a low level, so that the voltage $V_{N1}$ at the first node N1 is coupled to Vdata+Vth through the storage capacitor C. At the same time, a high-level voltage ELVDD is applied to the first voltage signal terminal, so that for the first transistor T1, $Vgs=V_{N1}-ELVDD=Vdata+Vth-ELVDD<Vth$, and thereby the first transistor T1 is turned on to cause the light emitting element D to emit light, wherein current flowing through the light emitting element D is:

$$I_d = \frac{1}{2} * \mu * Cox * \frac{W}{L} * (Vgs - Vth)^2 = \frac{k}{2}(Vdata - ELVDD)^2 \quad (1)$$

where μ is field effect mobility of the first transistor T1, Cox is capacitance per unit area of the structure of the first transistor T1, and W/L is a width-to-length ratio of a channel of the first transistor T1.

It may be seen that, since the current Id flowing through the light emitting element is unrelated to Vth in the above equation (1), a function of compensating for Vth is realized.

Figure 6A:
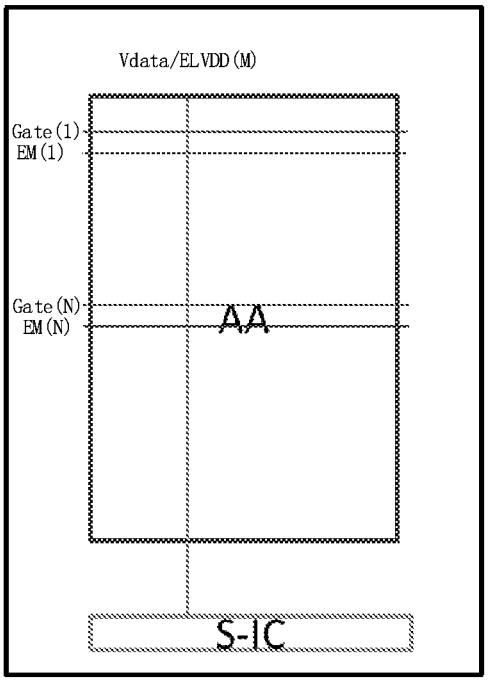
FIG. 6A is a schematic structural diagram of pixel circuits arranged in an array according to an example of the present disclosure.
Figure 6B:
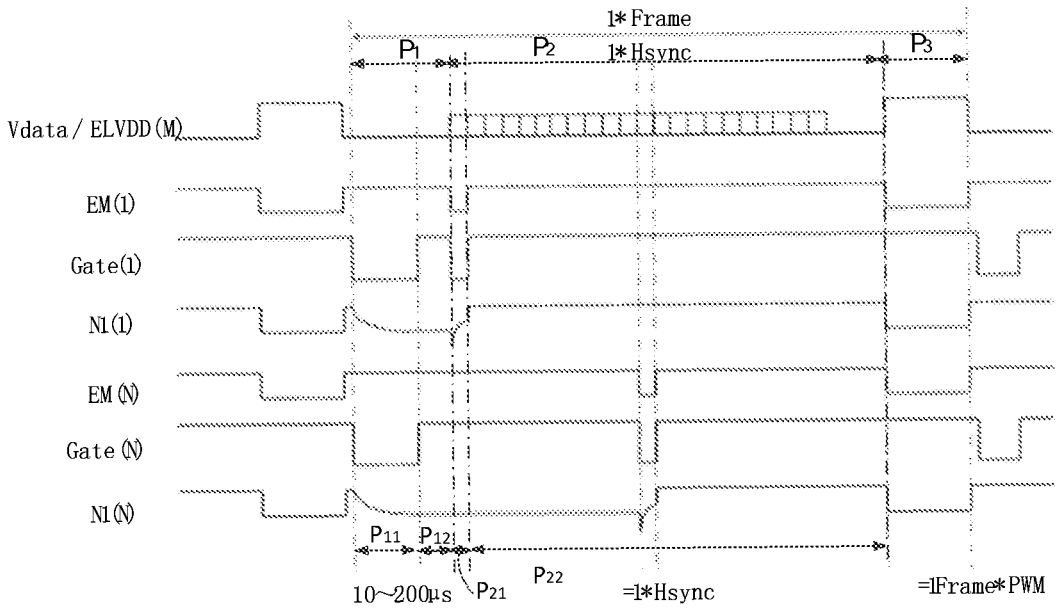
FIG. 6B is a schematic diagram of a driving timing during an operation of a pixel circuit according to an embodiment of the present disclosure.
Figure 7:
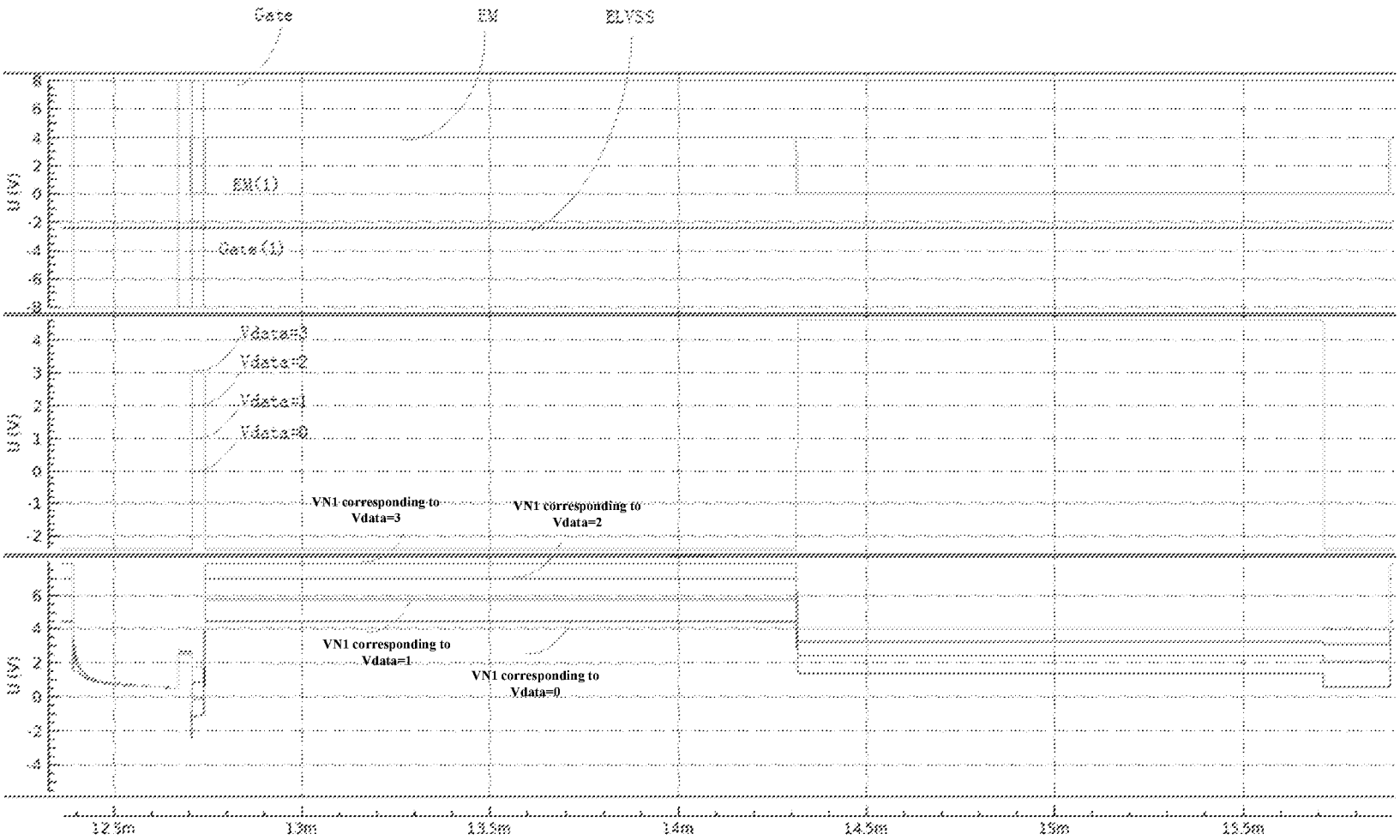
FIG. 7 is an analog waveform diagram of a pixel circuit according to an embodiment of the present disclosure when Vdata has a value of 0V to 3V.
Figure 8:
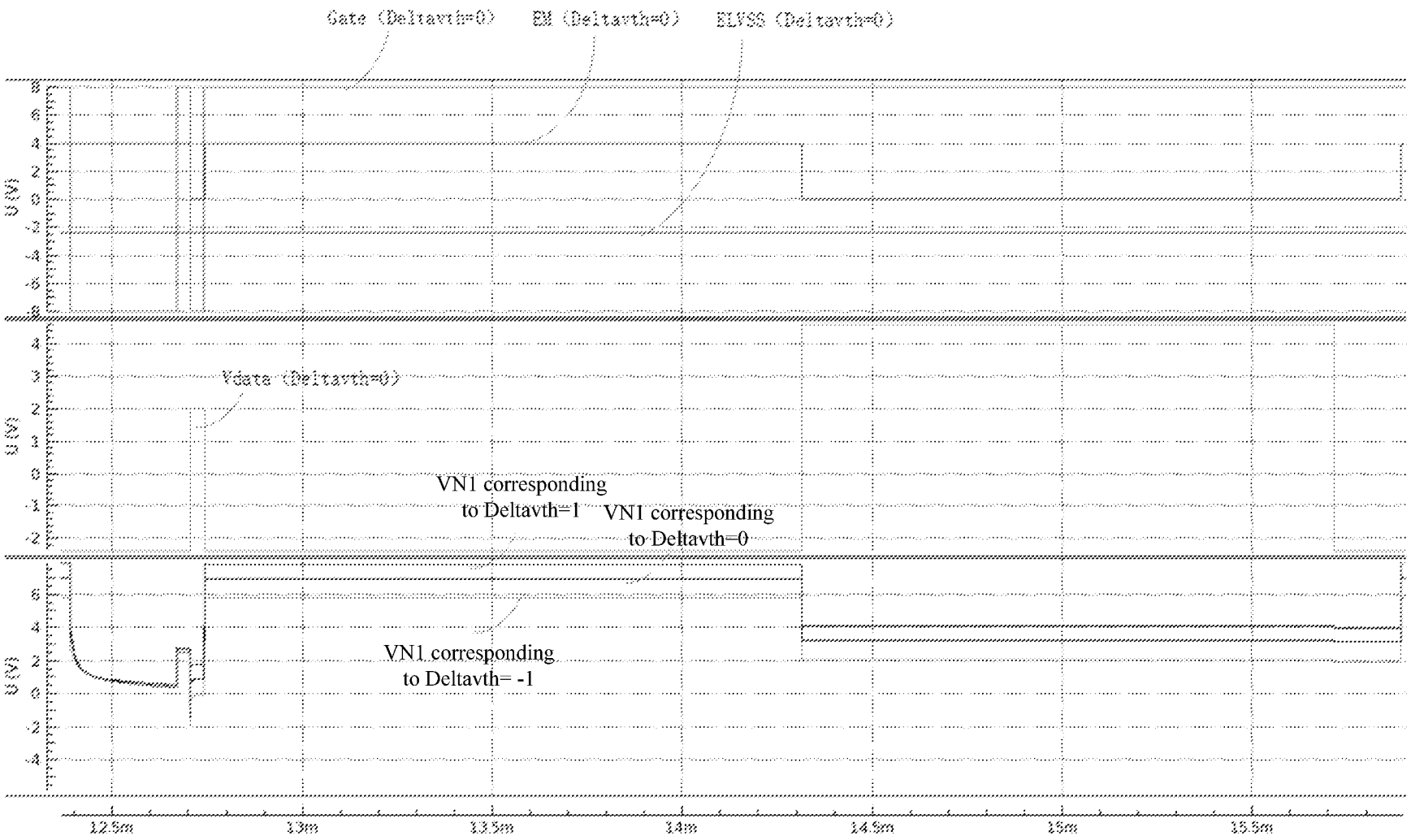
FIG. 8 is an analog waveform diagram of a pixel circuit according to an embodiment of the present disclosure when Vth has a value of −1V to 1V.

It should be illustrated that in FIGS. 6A and 6B, M and N are positive integers, M represents a number of columns where the pixel circuit is located, and N represents a number of rows where the pixel circuit is located. In order to further understand the pixel circuit according to the embodiment of the present disclosure, an operation of the pixel circuit according to the embodiment shown in FIG. 1 is simulated, and simulation results are shown in FIGS. 7 and 8. It may be seen from FIG. 7 that the function of writing Vdata may be realized in a case of different Vdata (0V to 3V). It may be seen from FIG. 8 that the function of extracting the threshold voltage Vth may be realized in a case of different ΔVth (−1V to 1V), and Vdata and the extracted Vth are written into the gate of the first transistor T1.

In summary, the pixel circuit according to the embodiment of the present disclosure may not only realize the function of compensating for Vth of the pixel circuit, but also has a small footprint, and may be widely used in display of an OLED with a high PPI.

Figure 9:
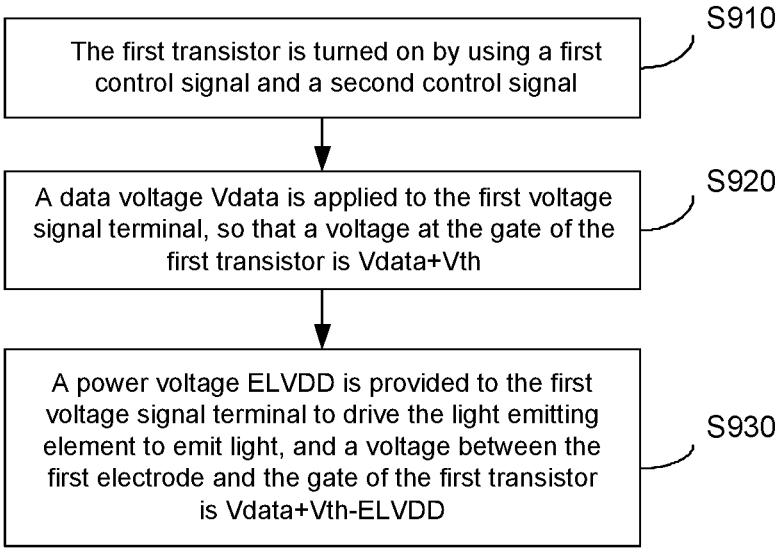
FIG. 9 is a flowchart of a method for driving a pixel circuit according to an embodiment of the present disclosure.

FIG. 9 is a flowchart of a method for driving a pixel circuit according to an embodiment of the present disclosure.

In the present embodiment, the pixel circuit is the pixel circuit according to the embodiments described above. As shown in FIG. 9, the method for driving a pixel circuit may comprise the following steps.

In S910, the first transistor is turned on by using a first control signal and a second control signal.

In S920, a data voltage Vdata is applied to the first voltage signal terminal, so that a voltage at the gate of the first transistor is Vdata+Vth, where Vth is a threshold voltage of the first transistor.

In S930, a power voltage ELVDD is provided to the first voltage signal terminal to drive the light emitting element to emit light, and a voltage between the first electrode and the gate of the first transistor is Vdata+Vth−ELVDD, where ELVDD>Vdata.

In one example of the present disclosure, when both of the first transistor and the second transistor are P-type thin film transistors, as shown in FIG. 6B, the method for driving a pixel circuit may comprise the following steps.

During a first sub-period of a first period, a first control signal is at a high level, a low-level voltage is applied to the first voltage signal terminal, and a second control signal is at a low level, to pull down a voltage at the gate of the first transistor; and during a second sub-period of the first period, the first control signal is at a high level and the second control signal is at a high level.

During a first sub-period of a second period, the second control signal is at a low level, the first control signal is at a low level, and a data voltage Vdata is applied to the first voltage signal terminal, so that the voltage at the gate of the first transistor is Vdata+Vth; and during a second sub-period of the second period, the second control signal is at a high level, and the first control signal is at a high level.

During a third period, the first control signal is at a low level, and a first voltage ELVDD is applied to the first voltage signal terminal to drive the light emitting element to emit light.

The method for driving a pixel circuit according to the embodiment of the present disclosure may not only realize the function of compensating for Vth, but also has a small footprint, and may be widely used in display of an OLED with a high PPI.

Figure 10:
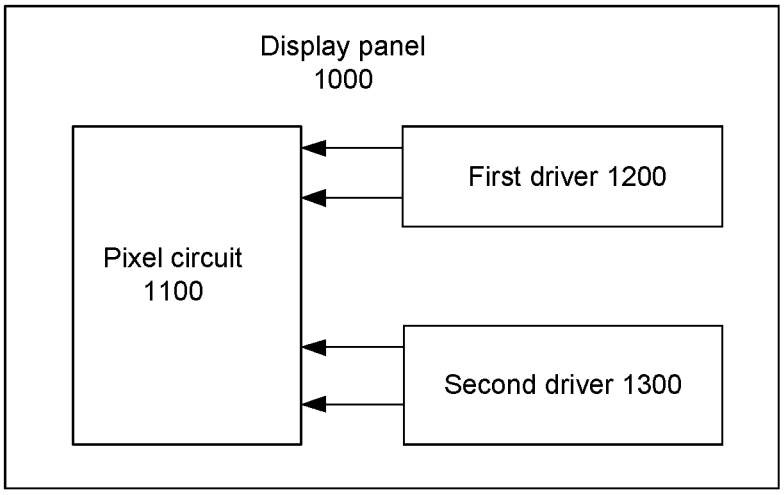
FIG. 10 is a structural block diagram of a display panel according to an embodiment of the present disclosure.

FIG. 10 is a structural block diagram of a display panel according to an embodiment of the present disclosure. As shown in FIG. 10, the display panel 1000 may comprise a pixel circuit 1100 according to the embodiment of the present disclosure, a first driver 1200, and a second driver 1300.

The first driver 1200 is configured to output a first control signal and a second control signal to the pixel circuit 1100, and the second driver 1300 is configured to apply corresponding voltage signals to the first voltage signal terminal and the second voltage signal terminal.

In the display panel according to the embodiment of the present disclosure, the pixel circuit described above is used, which may not only realize the function of compensating for Vth, but also has a small footprint, and may be widely used in display of an OLED with a high PPI.

Figure 11:
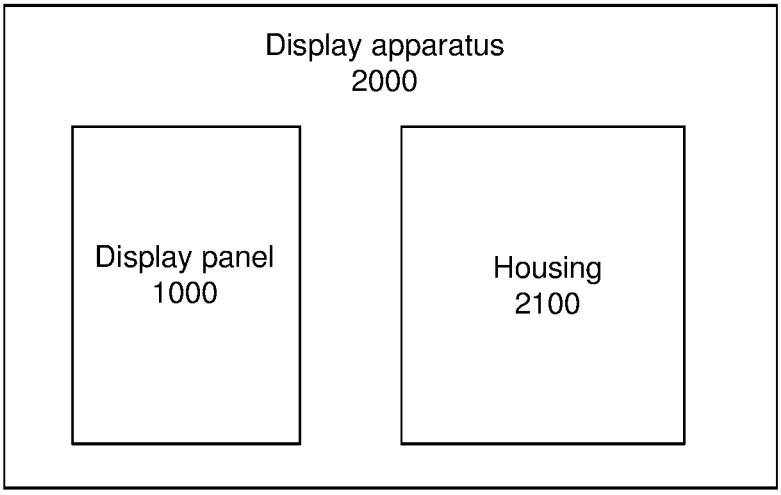
FIG. 11 is a structural block diagram of a display apparatus according to an embodiment of the present disclosure.

FIG. 11 is a structural block diagram of a display apparatus according to an embodiment of the present disclosure. As shown in FIG. 11, the display apparatus 2000 comprises a housing 2100 and the display panel 1000 according to the embodiment described above. Here, the housing 2100 is disposed opposite to the display panel 1000.

In the display apparatus according to the embodiment of the present disclosure, the display panel comprising the pixel circuit described above is used, which may not only realize the function of compensating for Vth, but also has a small footprint, and may be widely used in display of an OLED with a high PPI.

In the description of the present disclosure, the terms "first" and "second" are used for descriptive purposes only, and are not to be construed as indicating or implying relative importance or implicitly indicating a number of indicated technical features. Thus, features defined by "first" and "second" may explicitly or implicitly include at least one of the features.

In the present disclosure, unless explicitly stated and defined otherwise, terms such as "coupling" etc. should be broadly understood, for example, it may be fixed coupling, detachable coupling, or integrated coupling; or it may be direct coupling, or indirect coupling through an intermediate medium; or it may be internal connection between two elements or interaction between two elements, unless explicitly defined otherwise. Specific meanings of the above terms in the present disclosure may be understood by those of ordinary skill in the art according to specific situations.

In the description of the present specification, the description referring to the terms "one embodiment", "an example", "a specific example" etc. means that a specific feature, structure, material or characteristics described in conjunction with the embodiment or example is included in at least one embodiment or example of the present disclosure. In the present specification, schematic expressions of the above terms do not necessarily have to refer to the same embodiment or example. Furthermore, the specific feature, structure, material, or characteristics described may be combined in any suitable manner in any one or more embodiments or examples. In addition, those skilled in the art can combine and merge different embodiments or examples described in the present specification and features in different embodiments or examples without conflicting with each other.

Although the embodiments of the present disclosure have been illustrated and described above, it may be understood that the above embodiments are exemplary and are not to be construed as limiting the present disclosure. Changes, modifications, substitutions and variations can be made to the above embodiments by those of ordinary skill in the art within the scope of the present disclosure.

I claim:

1. A method for driving a pixel circuit, the pixel circuit comprises: a storage capacitor having a first terminal electrically coupled to a first control signal terminal for providing a first control signal; a first transistor having a first electrode electrically coupled to a first voltage signal terminal, and a gate electrically coupled to a second terminal of the storage capacitor; a second transistor having a first electrode electrically coupled to the gate of the first transistor, a second electrode electrically coupled to a second electrode of the first transistor, and a gate electrically coupled to a second control signal terminal for providing a second control signal; and a light emitting element having a first electrode electrically coupled to the second electrode of the second transistor, and a second electrode electrically coupled to a second voltage signal terminal;

wherein the method comprising:

turning on, during a first period, the first transistor by using a first control signal;

applying, during a second period, a data voltage Vdata to the first voltage signal terminal, so that a voltage at the gate of the first transistor is Vdata+Vth, wherein Vth is a threshold voltage of the first transistor; and applying, during a third period, a first voltage ELVDD to the first voltage signal terminal, so that a voltage between the first electrode and the gate of the first transistor is Vdata+Vth-ELVDD, wherein ELVDD>Vdata.

2. The method for driving a pixel circuit according to claim 1, further comprising, when both of the first transistor and the second transistor are P-type thin film transistors:

providing, during a first sub-period of the first period, the first control signal at a high level, applying a low-level voltage to the first voltage signal terminal, and providing the second control signal at a low level, to pull down a voltage at the gate of the first transistor; and providing, during a second sub-period of the first period, the first control signal at a high level, and providing the second control signal at a high level.

3. The method for driving a pixel circuit according to claim 1, further comprising, when both of the first transistor and the second transistor are P-type thin film transistors:

providing, during a first sub-period of the second period, the second control signal at a low level, providing the first control signal at a low level, and applying a data voltage Vdata to the first voltage signal terminal, so that the voltage at the gate of the first transistor is Vdata+Vth; and providing, during a second sub-period of the second period, the second control signal at a high level, and providing the first control signal at a high level.

4. The method for driving a pixel circuit according to claim 1, further comprising, when both of the first transistor and the second transistor are P-type thin film transistors:

during the third period, providing the first control signal at a low level, and applying a first voltage ELVDD to the first voltage signal terminal to drive the light emitting element to emit light.

5. The method for driving a pixel circuit according to claim 1, wherein the second transistor comprises a double-gate thin film transistor, wherein two gates of the double-gate thin film transistor are both electrically coupled to the second control signal terminal.

6. The method for driving a pixel circuit according to claim 1, wherein both of the first transistor and the second transistor are polycrystalline thin film transistors or zinc oxide thin film transistors.

7. The method for driving a pixel circuit according to claim 1, wherein the first transistor is a P-type or N-type thin film transistor, and the second transistor is a P-type or N-type thin film transistor.

8. The method for driving a pixel circuit according to claim 1, wherein the first electrode of the first transistor is a source, and the second electrode of the first transistor is a drain.

9. The method for driving a pixel circuit according to claim 1, wherein the first electrode of the first transistor is a drain, and the second electrode of the first transistor is a source.

* * * * *